US011846433B2

(12) United States Patent
Chaudhry et al.

(10) Patent No.: US 11,846,433 B2
(45) Date of Patent: Dec. 19, 2023

(54) HEATED WATER RECIRCULATION CONTROL

(71) Applicant: Rheem Manufacturing Company, Atlanta, GA (US)

(72) Inventors: Raheel A. Chaudhry, Montgomery, AL (US); David I. Vega Fernandez, Montgomery, AL (US); William T. McLemore, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 16/586,047

(22) Filed: Sep. 27, 2019

(65) Prior Publication Data

US 2021/0095866 A1 Apr. 1, 2021

(51) Int. Cl.
*F24D 19/10* (2006.01)
*F24D 17/00* (2022.01)
(Continued)

(52) U.S. Cl.
CPC ..... *F24D 19/1051* (2013.01); *F24D 3/08* (2013.01); *F24D 17/0078* (2013.01); *F24H 1/10* (2013.01); *F24H 9/2007* (2013.01); *F24H 15/238* (2022.01); *F24H 15/335* (2022.01); *F24D 2220/044* (2013.01); *F24H 15/215* (2022.01); *F24H 15/242* (2022.01);
(Continued)

(58) Field of Classification Search
CPC ..... F24D 19/1051; F24D 2220/044; F24D 17/0078; F24D 3/08; E03B 7/045; Y10T 137/6497; F24H 1/10; F24H 9/2007; F24H 15/238; F24H 15/335
USPC ..... 122/14.1
See application file for complete search history.

(56) References Cited

U.S. PATENT DOCUMENTS 4,819,587 A * 4/1989 Tsutsui ..... F23N 1/082 122/448.1
4,896,658 A * 1/1990 Yonekubo ..... F24D 19/1051 122/13.3
(Continued)

FOREIGN PATENT DOCUMENTS

CN 208671386 U 3/2019
JP H06185806 A * 7/1994 ..... F24D 17/00
(Continued)

OTHER PUBLICATIONS

International Search Report and Written Opinion for PCT Application No. PCT/US2020/052611 dated Dec. 30, 2020.

*Primary Examiner* — Steven S Anderson, II
(74) *Attorney, Agent, or Firm* — Eversheds Sutherland (US) LLP

(57) ABSTRACT

A heated water recirculation system includes a water heater having a water inlet and a water outlet. The heated water recirculation system further includes a flow detector positioned to detect inflow water flowing into the water heater through the water inlet. The heated water recirculation system also includes a controller configured to control operations of a recirculation pump based on a detection of the inflow water flowing into the water heater through the water inlet. The water heater is configured to provide heated water through the water outlet, and the recirculation pump is configured to circulate the heated water through the heated water recirculation system.

14 Claims, 9 Drawing Sheets

(51) Int. Cl.

| | |
|---|---|
| ***F24H 15/238*** | (2022.01) |
| ***F24H 15/335*** | (2022.01) |
| ***F24H 15/215*** | (2022.01) |
| ***F24H 15/242*** | (2022.01) |
| ***F24H 15/31*** | (2022.01) |
| ***F24H 15/414*** | (2022.01) |
| ***F24H 15/486*** | (2022.01) |
| ***F24H 15/325*** | (2022.01) |
| ***F24H 1/10*** | (2022.01) |
| ***F24D 3/08*** | (2006.01) |
| ***F24H 9/20*** | (2022.01) |
| *F24H 15/281* | (2022.01) |

(52) U.S. Cl.

CPC ..... *F24H 15/281* (2022.01); *F24H 15/31* (2022.01); *F24H 15/414* (2022.01); *F24H 15/486* (2022.01); *Y10T 137/6497* (2015.04)

(56) References Cited

U.S. PATENT DOCUMENTS 4,936,289 A * 6/1990 Peterson ..... F24D 17/0078 122/13.3
5,564,462 A * 10/1996 Storch ..... F24D 17/0078 122/13.3
5,829,467 A * 11/1998 Spicher ..... F24D 17/0078 137/14
7,050,706 B2 5/2006 Israelsohn et al.
9,562,697 B2 * 2/2017 Ng ..... E03B 7/045
9,841,197 B2 12/2017 Sato et al.
9,886,043 B2 * 2/2018 Yuge ..... F24D 17/0026
2005/0006402 A1 * 1/2005 Acker ..... F24D 17/0078 222/63
2010/0096018 A1 * 4/2010 Wylie ..... F24H 1/122 137/2
2010/0126604 A1 * 5/2010 Lund ..... F24D 17/0078 137/565.01
2014/0060660 A1 * 3/2014 Lebkuchner ..... F24D 17/0078 137/2
2014/0229022 A1 * 8/2014 Deivasigamani ... F24D 17/0036 700/282
2015/0053151 A1 * 2/2015 Graff ..... F24H 9/2035 122/14.21
2015/0354832 A1 * 12/2015 Sato ..... F24H 1/145 122/18.4
2016/0186415 A1 * 6/2016 Yuge ..... F24D 17/0026 137/340
2016/0223209 A1 * 8/2016 Lehrian ..... F24D 17/0078
2017/0363301 A1 * 12/2017 Son ..... F24D 19/1051
2018/0347830 A1 * 12/2018 Callahan ..... F24D 17/0078
2018/0363925 A1 * 12/2018 Deivasigamani ..... F24H 9/14
2019/0024908 A1 * 1/2019 Chaudhry ..... F24H 9/2021
2019/0078794 A1 * 3/2019 Heo ..... F24D 17/0094

FOREIGN PATENT DOCUMENTS

RU 2105247 C1 2/1998
RU 182781 U1 8/2018

* cited by examiner

HEATED WATER RECIRCULATION CONTROL

TECHNICAL FIELD

The present disclosure relates generally to water heaters, and more particularly to controlling operations of a heated water recirculation system that includes a crossover valve.

BACKGROUND

A heated water recirculation system may include a recirculation pump that pumps water through the heated water recirculation system including through a water heater of the heated water recirculation system. In some cases, the heated water recirculation system may include crossover valve that may open or closed. For example, when the crossover valve is open, heated water from the water heater may circulate back to the water heater through the crossover valve. When the crossover valve is closed, the heated water from the water heater is prevented from circulating back to the water heater. Pumping water by the recirculation pump while the crossover valve is closed may result in excessive pressure buildup that can cause equipment and other damage. Thus, a solution that reduces risks associated with operating a heated water recirculation system that includes a crossover valve is desirable.

SUMMARY

The present disclosure relates generally to water heaters, and more particularly to controlling operations of a heated water recirculation system that includes a crossover valve. In some example embodiments, a heated water recirculation system includes a water heater having a water inlet and a water outlet. The heated water recirculation system further includes a flow detector positioned to detect inflow water flowing into the water heater through the water inlet. The heated water recirculation system also includes a controller configured to control operations of a recirculation pump based on a detection of the inflow water flowing into the water heater through the water inlet. The water heater is configured to provide heated water through the water outlet, and the recirculation pump is configured to circulate the heated water through the heated water recirculation system.

In some example embodiments, a heated water recirculation system includes a water heater having a water inlet and a water outlet. The system further includes a flow detector positioned to detect inflow water flowing into the water heater through the water inlet. The system also includes a recirculation pump configured to pump water through the heated water recirculation system when the recirculation pump is powered on and a crossover valve configured to provide a flow path between the water outlet and the water inlet outside of the water heater when the crossover path is open. The system further includes a controller configured to control operations of the recirculation pump based on a detection of the inflow water flowing into the water heater through the water inlet.

In some example embodiments, a method of controlling a recirculation of heated water includes determining, by a controller, whether a water recirculation pump is powered on, where, when powered on, the water recirculation pump is configured to circulate heated water through a water recirculation system that includes a water heater and a crossover valve. The crossover valve provides a flow path for the heated water to flow between the water outlet of the water heater and the water inlet of the water heater when the crossover valve is open. The method further includes determining, by the controller, whether an amount of inflow water flowing into the water heater is less than a threshold volume and powering off, by the controller, the water recirculation pump in response to determining that the amount of the inflow water flowing into the water heater is less than the threshold volume.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
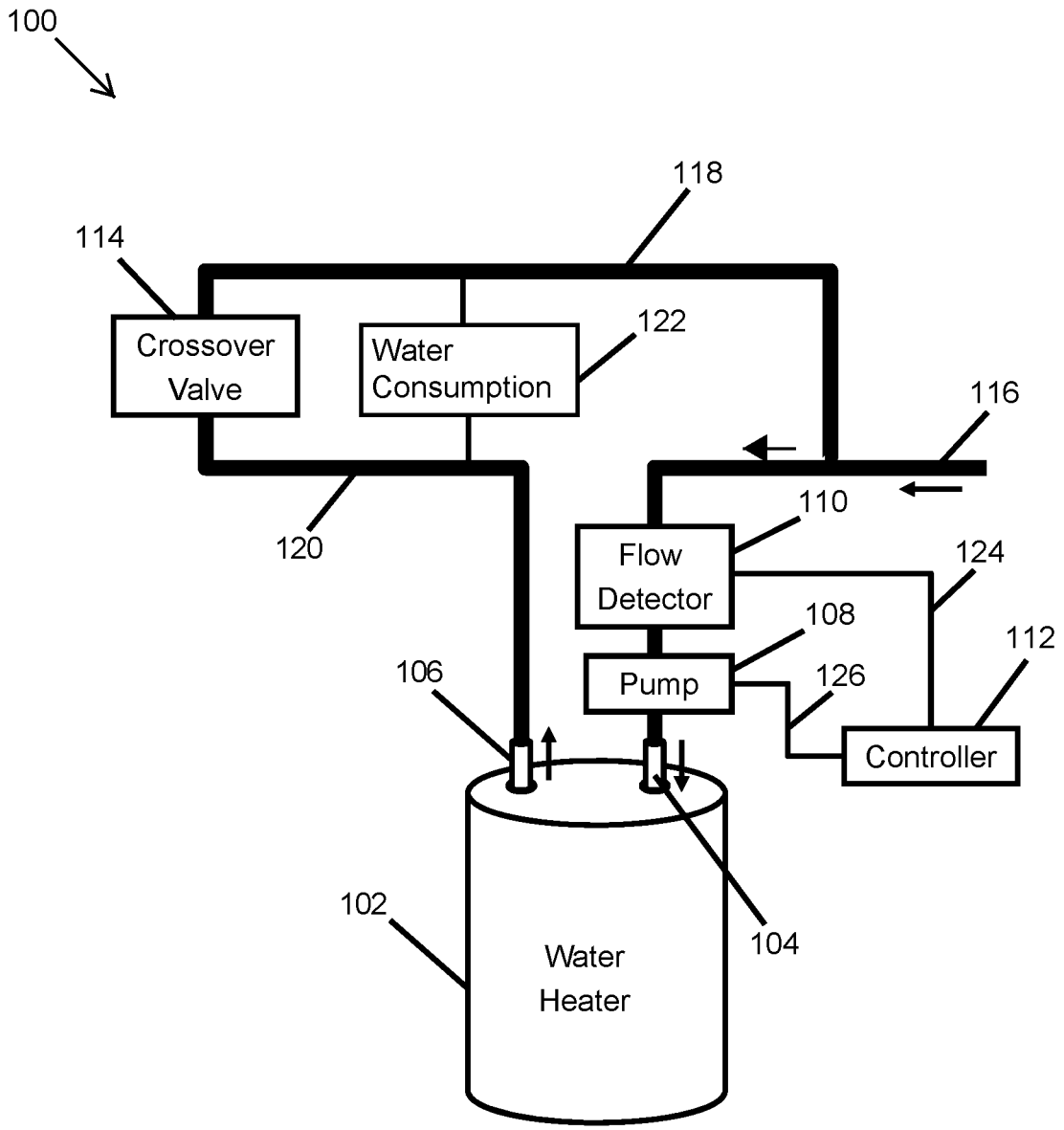
FIG. 1 illustrates a heated water recirculation system that includes a tank water heater and a crossover valve and that operates based on water flow detection according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding but not necessarily identical elements.

DETAILED DESCRIPTION OF THE EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a heated water recirculation system 100 that includes a tank water heater 102 and a crossover valve 114 and that operates based on water flow detection according to an example embodiment. In some example embodiments, the system 100 includes the water tank 102 that includes a water inlet 104 and a water outlet 106. The system 100 further includes a water recirculation pump 108, a flow detector 110, a controller 112, and a crossover valve 114. The crossover valve 114 may be fluidly coupled to the water inlet 104 and to the water outlet 106 and may provide a flow path for water to flow from the water outlet 106 to the water inlet 104. For example, the crossover valve 114 may be positioned between a piping 118 that is fluidly coupled to the water inlet 104 and a piping 120 that is fluidly coupled to the water outlet 106.

In some example embodiments, cold water from a municipality or another water source may flow to the system 100 through a water supply piping 116. For example, water may flow through the water supply piping 116 to the water heater 102 as well as to a water consumption apparatus 122 (e.g., a sink faucet, a shower, etc.). The water heater 102 may receive cold water through the water supply piping 116 and through the water inlet 104 and heat the cold water. The heating of the water in the water heater 102 may be controlled by a thermostat setting of the water heater 102 as can be readily understood by those of ordinary skill in the art with the benefit of this disclosure. To illustrate, the tank water heater 102 may include a heat exchanger and/or other components that are typically included in and/or outside of a tank water heater. For example, the water heater 102 may be a gas-fired or an electrical water heater 102.

In some example embodiments, the water that is heated by the water heater 102 may exit the water heater 102 through the water outlet 106 and flow to the crossover valve 114 and to the water consumption apparatus 122 through the piping 120. The crossover valve 114 may be a temperature-controlled valve that opens and closes based on, for example, the temperature of the water from the water heater 102 at the crossover valve 114. When the crossover valve 114 is at least partially open, the crossover valve 114 may provide a flow path for at least some of the water in the piping 120 from the water heater 102 to circulate back to the water heater 102 through the piping 118 and the water inlet 104. When the crossover valve 114 is fully closed, the crossover valve 114 may prevent the water in the piping 120 from circulating back to the water heater 102 through the piping 118 and the water inlet 104.

In some example embodiments, when the recirculation pump 108 is powered on, the recirculation pump 108 may pump water into the water inlet 104 to recirculate water through the heated water recirculation system 100. To illustrate, when the crossover valve 114 is open, the water heater 102 may be in a closed loop with the crossover valve 114, and water that enters the water heater 102 through the water inlet 104 may be heated by the water heater 102 and may flow out of the water heater 102 through the water outlet 106 and circulate back to the water heater 102 unless the water is consumed by the water consumption apparatus 122. The operation of the recirculation pump 108 may be controlled by a user input provided directly or indirectly to the recirculation pump 108, based on a timer that is external to or integrated in the recirculation pump 108, and/or the controller 112.

In some example embodiments, the flow detector 110 may be positioned to detect water flow into the water heater 102 through the water inlet 104. For example, the flow detector 110 may include a flow switch that detects water and indicates whether water is detected. As another example, the flow detector 110 may be a flow sensor that detects the amount of water (i.e., inflow water) flowing into the water heater 102 through the water inlet 104 and provides information indicative of the amount of the water. The flow detector 110 may provide a flow detection signal to the controller 112 via an electrical connection 124, where the flow detection signal indicates whether water flow is detected and/or the amount of detected water. The flow detector 110 may generate the flow detection signal in a manner known to those of ordinary skill in the art with the benefit of this disclosure.

In some example embodiments, the controller 112 may receive the flow detection signal from the flow detector 110 and control the recirculation pump 108 based on the flow detection signal. To illustrate, the controller 112 may provide a control signal to the recirculation pump 108 via an electrical connection 126 to control the operation of the recirculation pump 108. For example, the controller 112 may use the control signal to power on the recirculation pump 108 to start pumping water, and the controller 112 may use the control signal to power off the recirculation pump 108 to stop pumping water. In general, powering off the recirculation pump 108 stops the recirculation pump 108 from pumping water but may not necessarily fully shut down the recirculation pump 108, and powering on the recirculation pump 108 may start the pumping of water by the recirculation pump 108.

In some example embodiments, in response to the flow detection signal from the flow detector 110 indicating no water is detected by the flow detector 110, the controller 112 may control the recirculation pump 108 to stop pumping. To illustrate, when the crossover valve 114 is closed, the heated water exiting the water heater 102 through the water outlet 106 may be prevented by the crossover valve 114 from circulating back to the water heater 102 through the piping 118 and the water inlet 104. When heated water in the piping 120 is not being consumed by the water consumption apparatus 122 while the crossover valve 114 is closed, the piping 120 may fill up such that heated water stops flowing out from the water heater 102 and the flow of water into the water heater 102 (through the water inlet 104) stops. The flow detector 110 may detect the absence of water flow into the water heater 102 and send the flow detection signal to the controller 112 indicating that no water flow is detected. In response to the indication that no water flow is detected, the controller 112 may send the control signal to the recirculation pump 108 via the electrical connection 126 to power off the recirculation pump 108 or to otherwise control the recirculation pump 108 to stop pumping. For example, powering off or otherwise stopping pumping by the recirculation pump 108 may prevent excessive water pressure from building up in the heated water recirculation system 100 when the crossover valve 114 is closed.

In some example embodiments, the crossover valve 114 may be partially open such that some water passes through the crossover valve 114 from the piping 120. The flow detector 110 may determine the amount of water flowing into the water heater 102 through the water inlet 104 and send the flow detection signal to the controller 112 indicating the amount of water. If the amount of water flow indicated by the flow detection signal equals or is less than a threshold volume, the controller 112 may send the control signal to the recirculation pump 108 via the electrical connection 126 to power off the recirculation pump 108 or to otherwise control the recirculation pump 108 to stop pumping. For example, the threshold volume may be any detectable amount of water or 1%, 5%, 10%, or another percentage of the maximum amount of water that can flow into the water heater 102 through the water inlet 104. In some example embodiments, the threshold volume may be set to 0, which corresponds to a fully closed crossover valve and a total stoppage of water flow into the water heater 102 through the water inlet 104. In general, the threshold volume may depend on a particular heated water recirculation system as can be readily understood by those of ordinary skill in the art with the benefit of this disclosure.

In some example embodiments, the controller 112 may include one or more microcontrollers, microprocessors, or another integrated circuit component (e.g., an FPGA) that execute a software code stored in one or more non-transitory memory devices to perform the functions of the controller 112. For example, the controller 112 may include or may be communicably coupled to a non-volatile memory device containing executable software code and data. In some example embodiments, the controller 112 may include other components such as an analog-to-digital converter, a digital-to-analog converter, etc. as can be readily understood by those of ordinary skill in the art with the benefit of this disclosure.

By power off or otherwise stopping the recirculation pump 108 based on the amount of water flow into the water heater 102, the controller 112 may prevent excessive water pressure from building up in the heated water recirculation system 100. Preventing excessive water pressure from building up in the heated water recirculation system 100 may reduce risks of damage to components such as the water heater 102, the recirculation pump 108, the crossover valve 114, the piping 118, 120, etc.

In some alternative embodiments, the heated water recirculation system 100 may include a check valve at the piping 116 to prevent back flow to toward the water supply. In some alternative embodiments, the heated water recirculation system 100 may include more or fewer components than shown without departing from the scope of this disclosure. In some alternative embodiments, some of the components of the heated water recirculation system 100 may be connected in a different configuration without departing from the scope of this disclosure. To illustrate, the recirculation pump 108 may be at a different location than shown in FIG. 1. For example, the recirculation pump 108 may be located at the water outlet 106. In some alternative embodiments, some of the components of the heated water recirculation system 100 may be integrated into a single component. For example, the controller 112 may be integrated in the recirculation pump 108. In some example embodiments, the piping 116, 118, 120 may each include multiple pipe segments without departing from the scope of this disclosure. In some example embodiments, the water heater 102 may include components other than shown without departing from the scope of this disclosure. In some example embodiments, the water consumption apparatus 122 may include multiple apparatuses.

Figure 2:
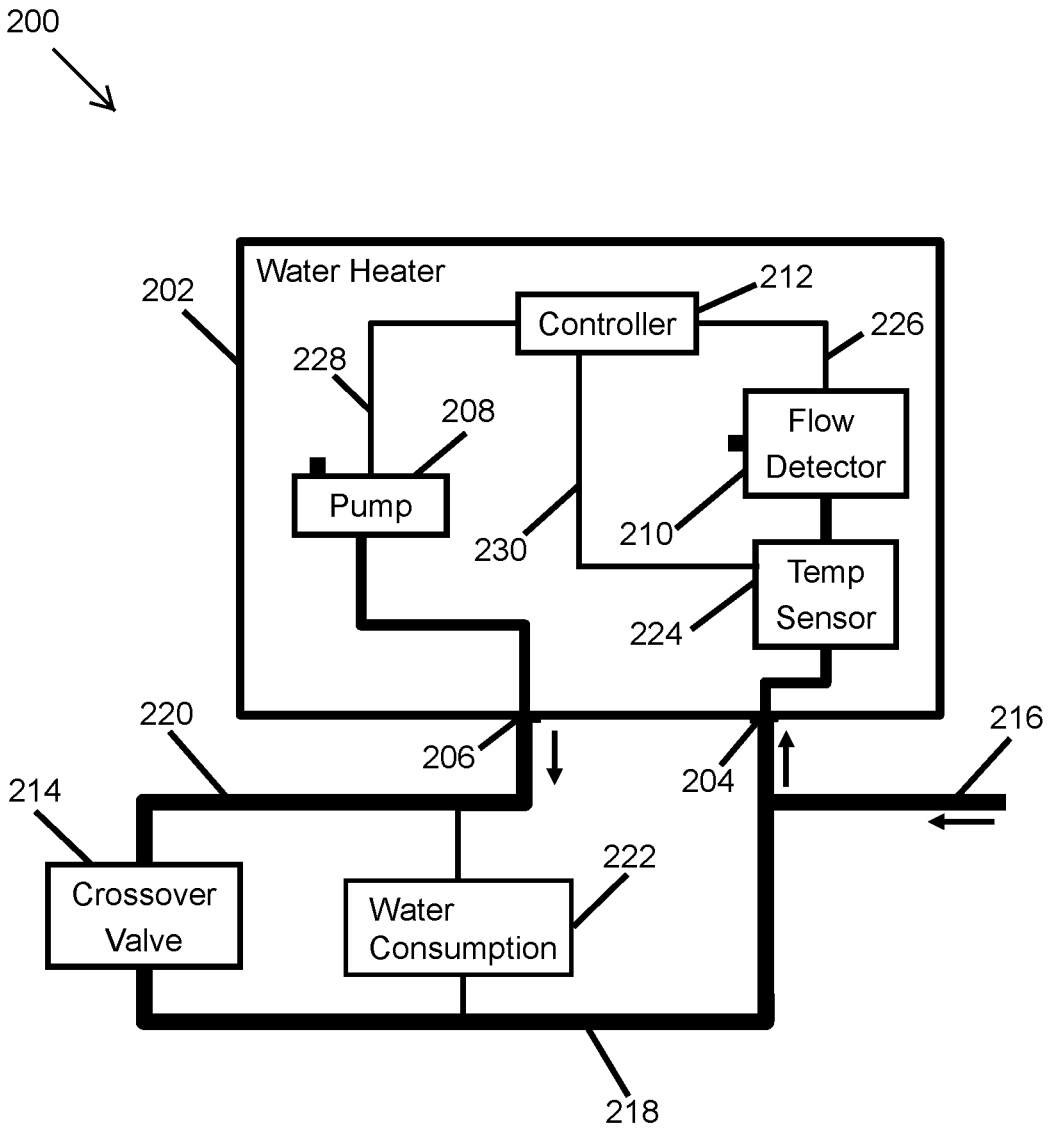
FIG. 2 illustrates a heated water recirculation system that includes a tankless water heater and a crossover valve and that operates based on water flow detection according to an example embodiment.

FIG. 2 illustrates a heated water recirculation system 200 that includes a tankless water heater 202 and a crossover valve 214 and that operates based on water flow detection according to an example embodiment. In some example embodiments, except for differences associated with the tank water heater 102 and the tankless water heater 202, the heated water recirculation system 200 may operate in a similar manner as the heated water recirculation system 100.

In some example embodiments, the heated water recirculation system 200 includes the tankless water heater 202, a crossover valve 214, and a water consumption apparatus 222. A piping 218 may be coupled to the crossover valve 214 and to a water inlet 204 of the water heater 202. A piping 220 may be coupled to the crossover valve 214 and to a water outlet 206 of the water heater 202, where the crossover valve 214 is coupled between the piping 218 and the piping 220. The crossover valve 214 may correspond to and operate in a similar manner as the crossover valve 114 of FIG. 1.

In some example embodiments, cold water from a municipality or another water source may flow to the system 200 through the water supply piping 216. For example, water may flow through the water supply piping 216 to the water heater 202 as well as to a water consumption apparatus 222 (e.g., a sink faucet, a shower, etc.). The water heater 202 may receive cold water through the water supply piping 216 and through the water inlet 204 and heat the cold water. The heating of the water in the water heater 202 may be controlled by a thermostat setting of the water heater 202 as can be readily understood by those of ordinary skill in the art with the benefit of this disclosure. To illustrate, the tankless water heater 202 may include a heat exchanger and/or other components that are typically included in and/or outside of a tankless water heater. For example, the water heater 202 may be a gas-fired or an electrical tankless water heater.

In some example embodiments, the water heater 202 may include a recirculation pump 208, a flow detector 210, a controller 212, and a temperature sensor 224. The temperature sensor 224 may be configured to sense the temperature of the water entering the water heater 202 through the water inlet 204. The temperature sensor 224 may provide the temperature information to the controller 212 that may power off the recirculation pump 208 if the temperature exceeds a threshold temperature.

In some example embodiments, the recirculation pump 202 may correspond to and operate in a similar manner as the recirculation pump 108 described with respect to FIG. 1. The flow detector 210 may correspond to and operate in a similar manner as the flow detector 110 described with respect to FIG. 1. For example, the flow detector 210 may detect the water flow and/or the amount of water (i.e., inflow water) flowing into the water heater 202 through the water inlet 204 and may provide a flow detection signal to the controller 212 via an electrical connection 226. The flow detection signal may indicate whether water flow into the water heater 202 is detected by the flow detector 210 and/or the amount of water flowing into the water heater 202 through the water inlet 204. For example, the flow detection signal may indicate that no water is detected, water is detected, or an amount of detected water.

In some example embodiments, the controller 212 may receive the flow detection signal from the flow detector 210 and control the recirculation pump 208 based on the flow detection signal in a similar manner as described with respect to the controller 112 and FIG. 1. To illustrate, the controller 212 may provide a control signal to the recirculation pump 208 via an electrical connection 228 to control the operation of the recirculation pump 208 based on whether the amount of water flow exceeds a threshold volume (e.g., any amount of water or 1%, 5%, 10%, or another percentage of the maximum amount of water that can flow into the water heater 202 through the water inlet 204). For example, the controller 212 may use the control signal to power on (e.g., start pumping water) and power off (i.e., stop pumping water) the recirculation pump 208. In general, powering off the recirculation pump 208 may stop the recirculation pump 208 from pumping water but may not necessarily shut down the recirculation pump 208, and powering on the recirculation pump 208 may start the pumping of water.

The controller 212 may correspond to and operate in a similar manner as the controller 112 of FIG. 1. For example, the controller 202 may include one or more microcontrollers, microprocessors, or another integrated circuit component (e.g., an FPGA) that execute a software code stored in one or more non-transitory memory devices to perform the functions of the controller 212.

In some example embodiments, water that is heated by the water heater 202 may exit the water heater 202 through the water outlet 206 and flow to the crossover valve 214 and to the water consumption apparatus 222 through the piping 220. When the crossover valve 214 is at least partially open, the crossover valve 214 may provide a flow path for at least some of the water in the piping 220 from the water heater 202 to circulate back to the water heater 202 through the piping 218 and the water inlet 204. When the crossover valve 214 is fully closed, the crossover valve 214 may prevent the water in the piping 220 from circulating back to the water heater 202 through the piping 218 and the water inlet 204.

In some example embodiments, when the recirculation pump 208 is powered on, the recirculation pump 208 may pump water that exits the water heater 202 through the water outlet 206 to recirculate water through the heated water recirculation system 200. To illustrate, when the crossover valve 214 is open, the water heater 202 is in a closed loop with the crossover valve 214, and water that enters the water heater 202 through the water inlet 204 may be heated by the water heater 202 and flow out of the water heater 202 through the water outlet 206 and circulate back to the water heater 202 unless the water is consumed by the water consumption apparatus 222. The operation of the recirculation pump 208 may also be controlled by a user input provided directly or indirectly to the recirculation pump 208, based on a timer that is external to or integrated in the recirculation pump 208, and/or the controller 212.

In some example embodiments, the flow detector 210 may be positioned to detect water flow into the water heater 202 through the water inlet 204. For example, the flow detector 210 may include a flow switch that detects water and indicates whether water is detected. As another example, the flow detector 210 may be a flow sensor that detects the amount of water flowing into the water heater 202 through the water inlet 204 and provides to the controller 212 information indicative of the amount of water flow using the flow detection signal. The flow detection signal indicates whether water flow is detected and/or the amount of detected water. The flow detector 210 may generate the flow detection signal in a manner known to those of ordinary skill in the art with the benefit of this disclosure.

In some example embodiments, the controller 212 may receive the flow detection signal from the flow detector 210 and control the recirculation pump 208 based on the flow detection signal in a similar manner as described with respect to the controller 112 of FIG. 1. By powering off or otherwise stopping the recirculation pump 208 based on the amount of water flow into the water heater 202, the controller 212 may prevent excessive water pressure from building up in the heated water recirculation system 200. Preventing excessive water pressure from building up in the heated water recirculation system 200 may reduce risks of damage to components such as the water heater 202, the recirculation pump 208, the crossover valve 214, the piping 218, 220, etc.

In some alternative embodiments, the heated water recirculation system 200 may include a check valve at the piping 216 to prevent back flow to toward the water supply. In some alternative embodiments, the heated water recirculation system 200 may include more or fewer components than shown without departing from the scope of this disclosure. In some alternative embodiments, the some of the components of the heated water recirculation system 200 may be connected in a different configuration without departing from the scope of this disclosure. To illustrate, the recirculation pump 208 may be at a different location than shown in FIG. 2. For example, the recirculation pump 208 may be located at the water inlet 204. In some alternative embodiments, some of the components of the heated water recirculation system 200 may be integrated into a single component. For example, the controller 212 may be integrated in the recirculation pump 212. In some example embodiments, the piping 216, 218, 220 may each include multiple pipe segments without departing from the scope of this disclosure. In some example embodiments, the water heater 202 may include components other than shown without departing from the scope of this disclosure. In some example embodiments, the water consumption apparatus 222 may include multiple apparatuses.

Figure 3:
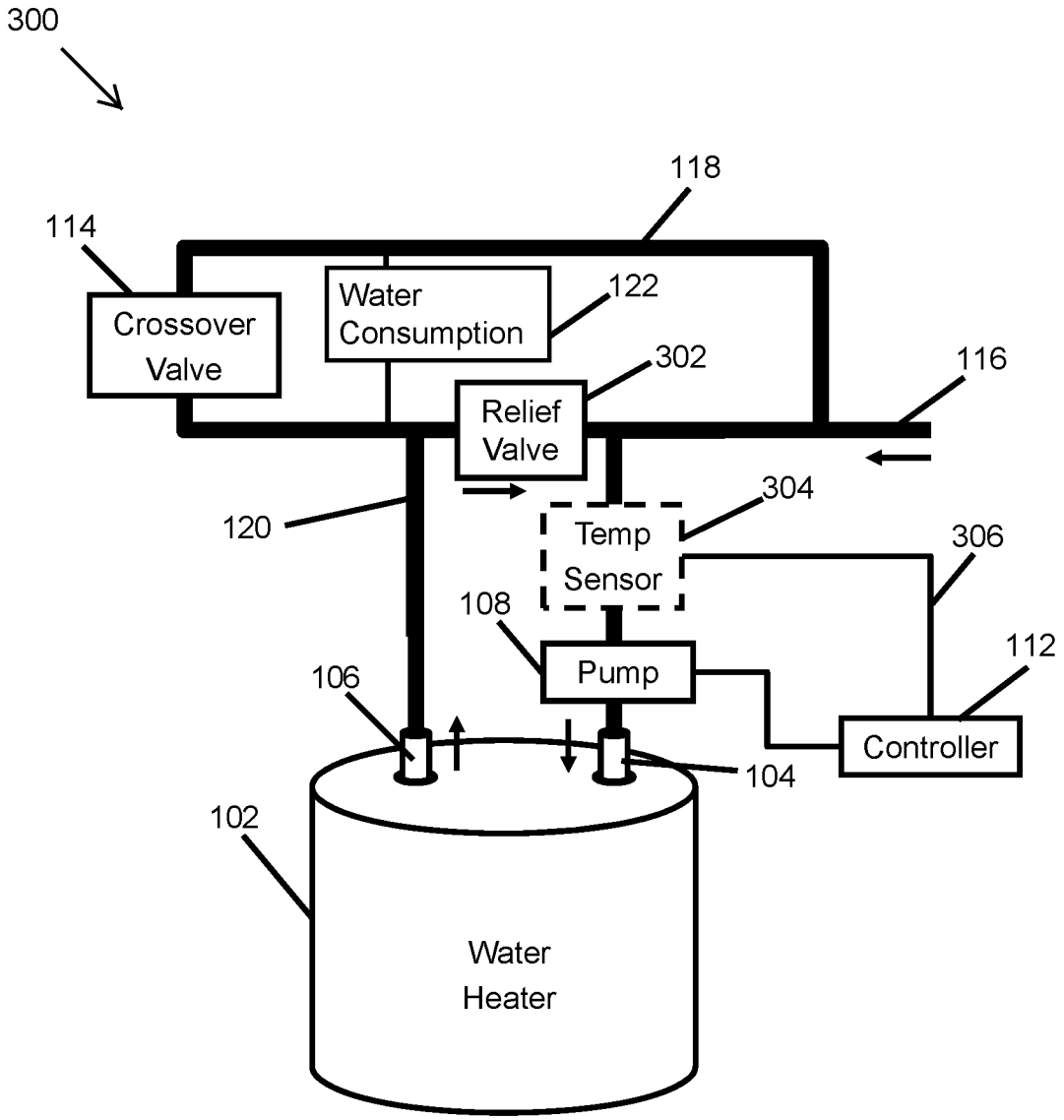
FIG. 3 illustrates a heated water recirculation system that includes a tank water heater and a crossover valve according to another example embodiment.

FIG. 3 illustrates a heated water recirculation system 300 that includes the tank water heater 102 and the crossover valve 114 according to another example embodiment. Referring to FIGS. 1 and 3, in some example embodiments, the heated water recirculation system 300 may include the water tank 102, the water recirculation pump 108, the controller 112, and the crossover valve 114 described above with respect to the heated water recirculation system 100 of FIG. 1. In general, the system 300 operates in as a similar manner as the system 100 to provide heated water and to circulate water through the system 300. As described above, cold water from a municipality or another water source may flow to the water heater 102 and to the water consumption apparatus 122 via the supply piping 116. Cold water from water source and/or circulated water may enter the water heater 102 through the water inlet 104 as inflow water and may be heated by the water heater 102. To illustrate, when the crossover valve 114 is open, water that exits the water heater 102 through the water outlet 106 may be circulated back to the water heater 102 through the piping 120, the crossover valve 114, the piping 118, and the water inlet 104. The recirculation pump 108 may operate to circulate the water through the heated water recirculation system 300 as described above with respect to FIG. 1.

In some example embodiments, in contrast to the system 100, the system 300 may include a pressure relief valve 302 that is fluidly coupled to the water inlet 104 and the water outlet 106. For example, the relief valve 302 may be coupled across the water inlet 104 and the water outlet 106 such that the input port/side of the relief valve 302 is coupled to the water outlet 106 and the output port/side of the relief valve 302 is coupled to the water inlet 104. The relief valve 302 may be closed when the water pressure at the input of the relief valve 302 is at or below a threshold pressure or when the water pressure across the relief valve 302 is at or below a threshold pressure. The relief valve 302 may be open to provide a flow path, for example, through the relief valve 302 when the water pressure at the input of the relief valve 302 exceeds a threshold pressure or when the pressure across the relief valve 302 exceeds a threshold pressure. Particular threshold pressure values may depend on a number of factors including the capacity of the water heater 102, etc. as can be readily understood by those of ordinary skill in the art with the benefit of this disclosure.

To illustrate, when the crossover valve 114 is closed, continued pumping by the recirculation pump 108 may result in increased pressure on the crossover valve 114 and in the components of the system 300 that are downstream of the recirculation pump 108 and upstream of the crossover valve 114. For example, if the recirculation pump 108 continues to pump water while the crossover valve 114 is closed, water pressure may continue to increase in the piping of the system 300, including the piping 120, between the water outlet 106 and the crossover valve 114. When the water pressure at the input of the relief valve 302 exceeds a threshold pressure, the relief valve 302 may open to provide a flow path for water to flow from the water outlet 106 to the water inlet 104. By allowing the water that exits the water heater 102 through the water outlet 106 to circulate back to the water heater 102 through the relief valve 302 and the water inlet 104, the relief valve 302 may prevent further increases in water pressure. By preventing further pressure increases, the relief valve 302 may prevent damages to the components of the system 300.

In some example embodiments, the heated water recirculation system 300 includes a temperature sensor 304 that is located relatively close to the water inlet 104. For example, the temperature sensor 304 may be located before the recirculation pump 108. Alternatively, temperature sensor 304 may be located between the recirculation pump 108 and the water inlet 104. In general, the temperature sensor 304 is located to sense the temperature of the water entering the water heater 102 through the water inlet 104.

In some example embodiments, the temperature sensor 304 may be coupled to the controller 112 via the electrical connection 306 and may provide temperature information indicating the temperature of the water entering the water heater 102 through the water inlet 104. As described above with respect to the system 300, the controller 112 may power off the recirculation pump 108 in response to the temperature information from the temperature sensor 304 indicating a temperature that exceeds a threshold temperature (e.g., 10 degrees, 30 degrees, or 50 degrees below the thermostat setting of the water heater 102). For example, the threshold temperature may be selected to avoid circulating water through the system 500 when the water temperature proximal to the water inlet 104 is above the threshold temperature, which may indicate that water having undesirably high temperature is circulating through the system 500.

For example, if heated water exiting the water heater 102 through the water inlet 106 flows back to the water heater 102 through the relief valve 302, the temperature of the water entering the water heater 102 through the water inlet 104 may exceed a threshold temperature. In response, the controller 112 may power off the recirculation pump 108 or otherwise stop the recirculation pump 108 from pumping water. When the recirculation pump 108 is powered back on, for example, based on a user input or a timer, the controller 112 may power off the recirculation pump 108 if the temperature of the water indicated by the temperature sensor 304 is not below the threshold temperature within a threshold time (e.g., 10 seconds after the recirculation pump 108 is powered on).

In some example embodiments, when the temperature sensor 304 indicates that the temperature of the water entering the water heater 102 is at or below the threshold temperature, the controller 112 may power on the recirculation pump 108 or otherwise control the recirculation pump 108 to start pumping water. Alternatively, the controller 112 may not power on the recirculation pump 108 based on the temperature of the water. As described above with respect to the system 100, the operation of the recirculation pump 108 may be controlled by a user input provided directly or indirectly to the recirculation pump 108, based on a timer that is external to or integrated in the recirculation pump 108, the controller 112, and/or another means as can be readily contemplated by those of ordinary skill in the art with the benefit of this disclosure.

In some alternative embodiments, the system 300 may include the flow detector 110, and the controller 112 may control the recirculation pump 108 in a similar manner as described with respect to FIG. 1.

In some example embodiments, the flow path provided by opening the relief valve 302 may or may not be through the relief valve 302 itself. For example, the relief valve 302 may open or close a flow path that is external to the relief valve 302 instead of through the relief valve 302 itself. In some alternative embodiments, the heated water recirculation system 300 may include more or fewer components than shown without departing from the scope of this disclosure.

In some alternative embodiments, some of the components of the heated water recirculation system 300 may be connected in a different configuration without departing from the scope of this disclosure. To illustrate, the recirculation pump 108 may be at a different location than shown in FIG. 3. For example, the recirculation pump 108 may be located at the water outlet 106. In some alternative embodiments, the relief valve 302 may be at a different location than shown in FIG. 3 without departing from the scope of this disclosure. In some alternative embodiments, some of the components of the heated water recirculation system 300 may be integrated into a single component. For example, the controller 112 may be integrated in the recirculation pump 108.

Figure 4:
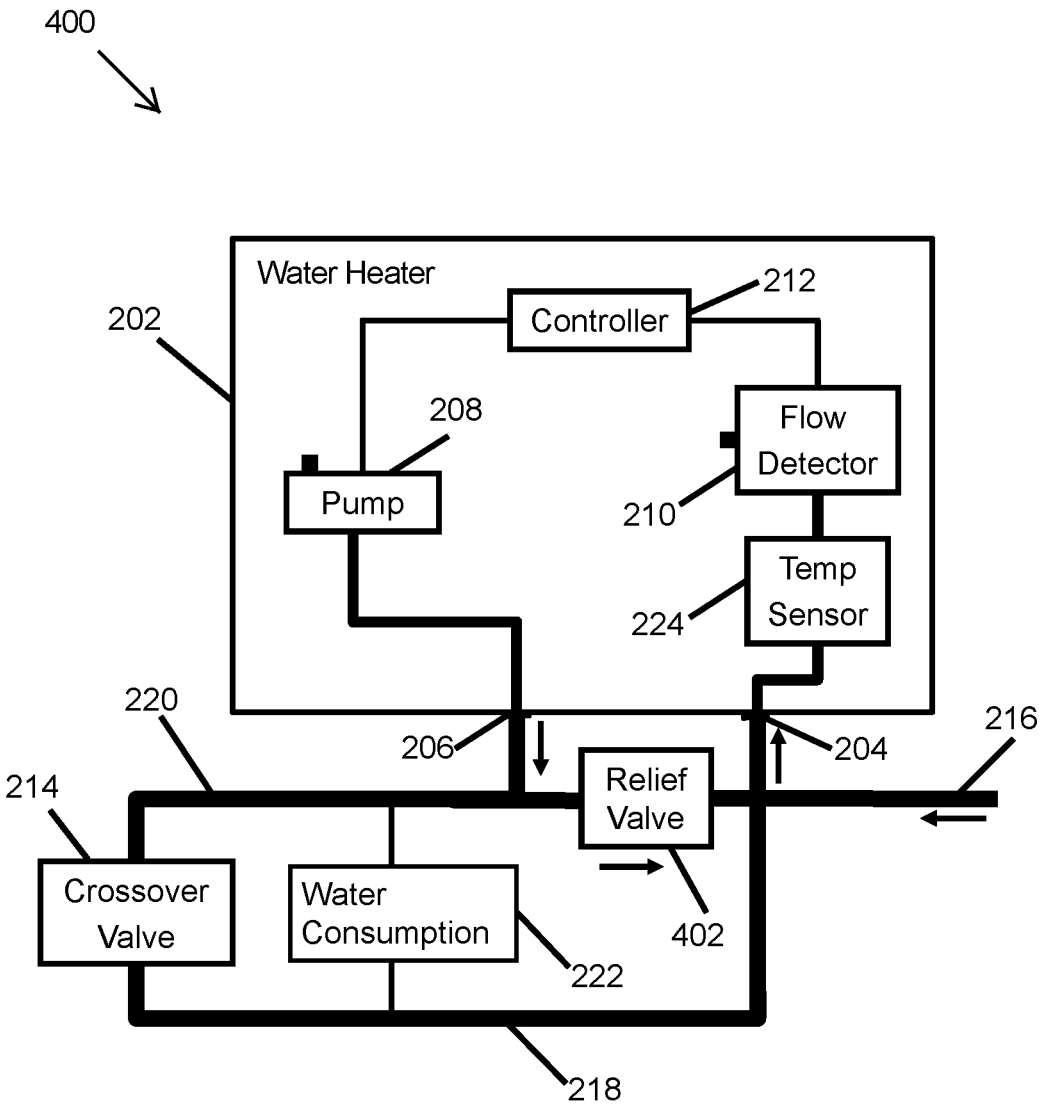
FIG. 4 illustrates a heated water recirculation system that includes a tankless water heater and a crossover valve according to another example embodiment.

FIG. 4 illustrates a heated water recirculation system 400 that includes the tankless water heater 202 and a crossover valve 214 according to another example embodiment. Referring to FIGS. 2 and 4, in some example embodiments, the heated water recirculation system 400 includes the tankless water heater 202, the crossover valve 214, and the water consumption apparatus 222 described above. In general, the system 400 operates in as a similar manner as the system 200 to provide heated water and to circulate water through the system 400. As described above with respect to FIG. 2, the water heater 202 may include the recirculation pump 208, the flow detector 210, the controller 212, and the temperature sensor 224.

In some example embodiments, the system 400 may include a relief valve 402 that is fluidly coupled to the water inlet 204 and the water inlet 206. In general, the relief valve 402 may operate in a similar manner as the relief valve 302 to relieve pressure in the system 400. For example, the relief valve 402 may be coupled across the water inlet 204 and the water outlet 206 such that the input port/side of the relief valve 402 is coupled to the water outlet 206 and the output port/side of the relief valve 402 is coupled to the water inlet 204. The relief valve 402 may be closed when the water pressure at the input of the relief valve 402 is at or below a threshold pressure or when the water pressure across the relief valve 402 is at or below a threshold pressure. The relief valve 402 may provide a flow path, for example, through the relief valve 402 when the water pressure at the input of the relief valve 402 exceeds a threshold pressure or when the pressure across the relief valve 402 exceeds a threshold pressure. Particular threshold pressure values depend on a number of factors including the capacity of the water heater 202 as can be readily understood by those of ordinary skill in the art with the benefit of this disclosure.

To illustrate, when the crossover valve 214 is closed, continued pumping by the recirculation pump 208 may result in increased pressure on the crossover valve 214 and in the components of the system 400 that are downstream of the recirculation pump 208 and upstream of the crossover valve 214. For example, if the recirculation pump 208 continues to pump water while the crossover valve 214 is closed, water pressure may continue to increase in the piping of the system 400, including the piping 220, between the water outlet 206 and the crossover valve 214. When the water pressure at the input of the relief valve 402 exceeds a threshold pressure, the relief valve 402 may open to provide a flow path for water to flow from the water outlet 206 to the water inlet 204. In general, the flow path provided by opening the relief valve 402 may or may not be through the relief valve 402 itself. For example, the relief valve 402 may open or close a flow path that is external to the relief valve 402 instead of through the relief valve 402 itself.

By allowing the water that exits the water heater 202 through the water outlet 206 to circulate back to the water heater 202 through the relief valve 402 and the water inlet 204, the relief valve 402 may prevent further increases in water pressure. By preventing further pressure increases, the relief valve 402 may prevent damages to the components of the system 400.

In some example embodiments, the temperature sensor 224 may be configured to sense the temperature of the water entering the water heater 202 through the water inlet 204. The temperature sensor 224 may provide temperature information indicating the temperature of the water, and the controller 212 may power off the recirculation pump 208 in response to the temperature information from the temperature sensor 224 indicating a temperature that exceeds a threshold temperature (e.g., 10 degrees, 30 degrees, or 50 degrees below the thermostat setting of the water heater 202). For example, the threshold temperature may be selected to avoid circulating water through the system 400 when the water temperature proximal to the water inlet 204 is above the threshold temperature, which may indicate that water having undesirably high temperature is circulating through the system 400.

When the recirculation pump 208 is powered back on, for example, based on a user input or a timer, the controller 212 may power off the recirculation pump 208 if the temperature of the water indicated by the temperature sensor 224 is not below the threshold temperature within a threshold time (e.g., 10 seconds after the recirculation pump 208 is powered on).

In some example embodiments, when the temperature sensor 224 indicates that the temperature of the water entering the water heater 202 is at or below the threshold temperature, the controller 212 may power on the recirculation pump 208 or otherwise control the recirculation pump 208 to start pumping water. Alternatively, the controller 212 may not power on the recirculation pump 208 based on the temperature of the water. In general, the operation of the recirculation pump 208 may be controlled by a user input provided directly or indirectly to the recirculation pump 208, based on a timer that is external to or integrated in the recirculation pump 108, and/or the controller 212.

In some alternative embodiments, the heated water recirculation system 400 may include more or fewer components than shown without departing from the scope of this disclosure. In some alternative embodiments, the some of the components of the heated water recirculation system 400 may be connected in a different configuration without departing from the scope of this disclosure. In some alternative embodiments, some of the components of the heated water recirculation system 400 may be integrated into a single component. For example, the controller 212 may be integrated in the recirculation pump 212. In some example embodiments, the relief valve 402 may control the opening and closing of a flow path that is external to the relief valve 402 instead of opening and closing a flow path through the relief valve 402 itself. In some alternative embodiments, the relief valve 402 may be at a different location than shown in FIG. 4 without departing from the scope of this disclosure.

Figure 5:
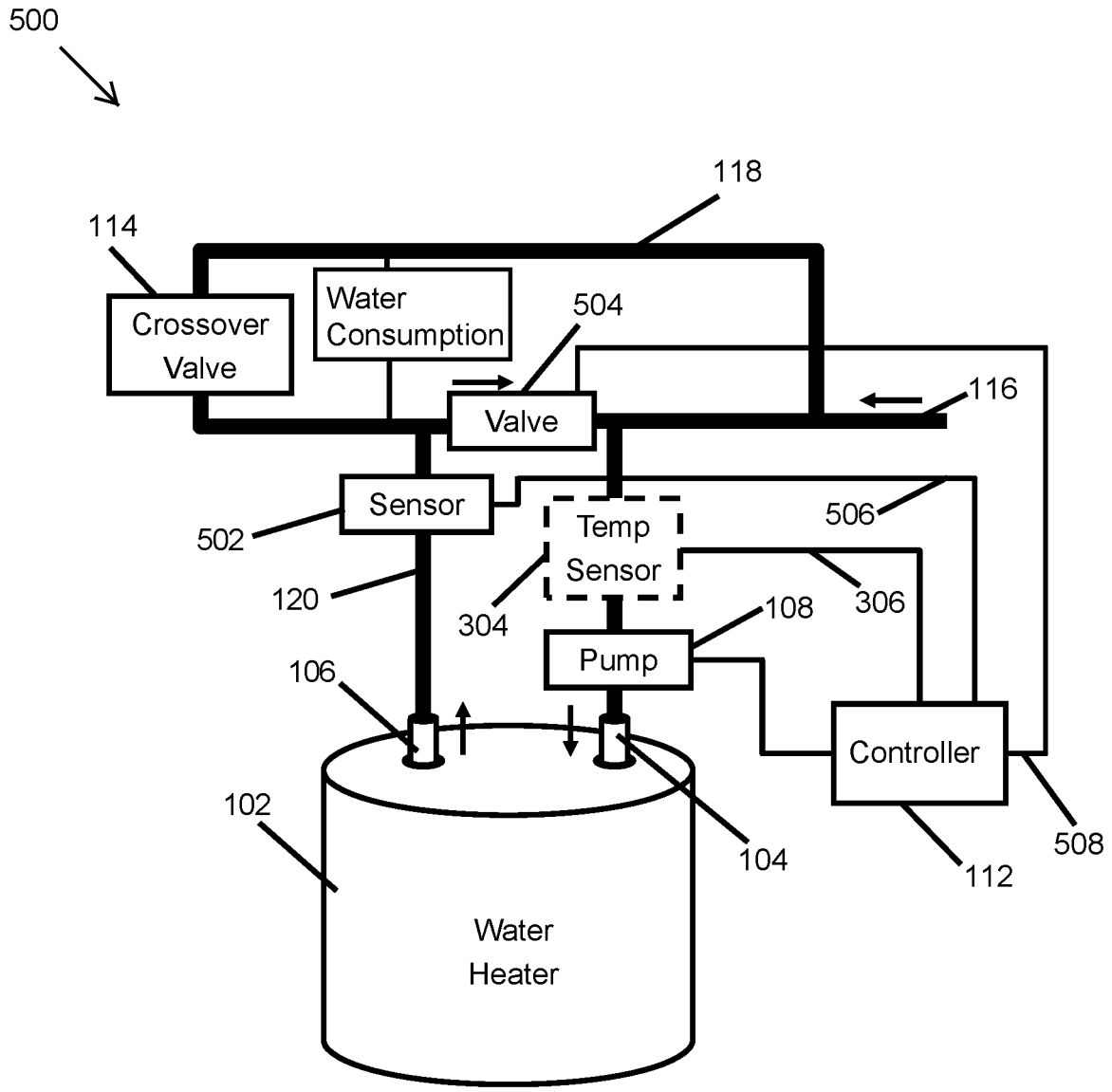
FIG. 5 illustrates a heated water recirculation system that includes a tank water heater and a crossover valve and that operates based on water pressure detection according to an example embodiment.

FIG. 5 illustrates a heated water recirculation system 500 that includes the tank water heater 102 and the crossover valve 114 and that operates based on water pressure detection according to an example embodiment. Referring to FIGS. 1, 3, and 5, the heated water recirculation system 500 may include the water tank 102, the water recirculation pump 108, the controller 112, and the crossover valve 114 described above with respect to the heated water recirculation system 100 of FIG. 1. In general, the system 500 operates in as a similar manner as the systems 100 and 300 to provide heated water and to circulate water through the system 500.

In some example embodiments, in contrast to the system 300 of FIG. 3, the system 500 may include a pressure sensor 502 and a valve 504 instead of the pressure relief valve 302. The sensor 502 may be coupled to the piping 120 to sense the water pressure in the system 500, and the valve 504 may be coupled across the water inlet 104 and the water outlet 106 such that the input port/side of the valve 504 is fluidly coupled to the water outlet 106 and the output port/side of the relief valve 504 is fluidly coupled to the water inlet 104. To illustrate, the pressure sensor 502 may be coupled to the piping 120 that is coupled to the water outlet 106 and may sense the water pressure in the piping 120. The pressure sensor 502 may provide pressure information indicative of the sensed water pressure to the controller 112 via an electrical connection 506. The controller 112 may compare the pressure indicated by the pressure information against a threshold pressure. For example, the controller 112 may determine whether the pressure indicated by the pressure information exceeds a threshold pressure. The threshold pressure may be set based on a number of factors including the capacity of the water heater 102 as can be readily understood by those of ordinary skill in the art with the benefit of this disclosure.

In some example embodiments, the controller 112 may provide a control signal to the valve 504 via an electrical connection 508 to control whether the valve 504 provides a flow path from the water outlet 106 to the water inlet 104. For example, the controller 112 may send a command to open the valve 504 in response to determining that the water pressure sensed by the sensor 502 exceeds a threshold pressure. As another example, the controller 112 may send a command to close the valve 504 in response to determining that the water pressure sensed by the sensor 502 is at or below the threshold pressure. As yet another example, the controller 112 may send a command to adjust the valve 504 based on the water pressure sensed by the sensor 502. For example, the valve 504 may be controlled to adjust the amount of water that flows from the water outlet 106 to the water inlet 104 through the valve 504.

In some example embodiments, when the crossover valve 114 is closed, continued pumping by the recirculation pump 108 may result in increased pressure on the crossover valve 114 and in the components of the system 500 that are downstream of the recirculation pump 108 and upstream of the crossover valve 114. For example, if the recirculation pump 108 continues to pump water while the crossover valve 114 is closed, water pressure may continue to increase in the piping of the system 500, including the piping 120, between the water outlet 106 and the crossover valve 114. If the controller 112 determines that the water pressure indicated by the pressure sensor 502 exceeds a threshold pressure, the controller 112 may control the valve 504 to provide a flow path (e.g., open the valve 504) for water to flow from the water outlet 106 to the water inlet 104. In general, the flow path provided by controlling or opening the valve 504 may or may not be through the valve 504 itself. By allowing water that exits the water heater 102 through the water outlet 106 to circulate back to the water heater 102 through the valve 504 and the water inlet 104, the system 500 may prevent excess water pressure build up in the system 500. By preventing excess pressure build up, the system 500 can prevent damages to the components of the system 500 while allowing the recirculation of water through the system 500 under safe pressure conditions.

In some example embodiments, when the crossover valve 114 is open again, the pressure in the pressure sensed by the pressure sensor 502 may decrease. If the water pressure indicated to the controller 112 by the pressure sensor 502 is below the threshold pressure, the controller 112 may send a command to the valve 504 to close the flow path from the water outlet 106 to the water inlet 104 through the valve 504.

In some example embodiments, the temperature sensor 304 may be coupled to the controller 112 via the electrical connection 306 and may provide temperature information indicating the temperature of the water entering the water heater 102 through the water inlet 104. As described above with respect to the system 300, the controller 112 may power off the recirculation pump 108 in response to the temperature information from the temperature sensor 304 indicating a temperature that exceeds a threshold temperature (e.g., 10 degrees, 30 degrees, or 50 degrees below the thermostat setting of the water heater 102). For example, the threshold temperature may be selected to avoid circulating water through the system 500 when the water temperature proximal to the water inlet 104 is above the threshold temperature, which may indicate that water having undesirably high temperature is circulating through the system 500.

For example, if heated water exiting the water heater 102 through the water inlet 106 flows back to the water heater 102 through the valve 502, the temperature of the water entering the water heater 102 through the water inlet 104 may exceed the threshold temperature. In response, the controller 112 may power off the recirculation pump 108. When the recirculation pump 108 is powered back on, for example, based on a user input or a timer, the controller 112 may power off the recirculation pump 108 if the temperature of the water indicated by the temperature sensor 304 is not below the threshold temperature within a threshold time (e.g., 10 seconds after the recirculation pump 108 is powered on).

In some example embodiments, when the temperature sensor 304 indicates that the temperature of the water entering the water heater 102 is at or below the threshold temperature, the controller 112 may power on the recirculation pump 108 or otherwise control the recirculation pump 108 to start pumping water. Alternatively, the controller 112 may not power on the recirculation pump 108 based on the temperature of the water. As described above, the operation of the recirculation pump 108 may be controlled by a user input provided directly or indirectly to the recirculation pump 108, based on a timer that is external to or integrated in the recirculation pump 108, and/or the controller 112.

In some alternative embodiments, the system 500 may include the flow detector 110 described above, and the system 500 may operate to control the recirculation pump 108 based on detection by the flow detector 100 in addition to limiting the pressure build up as described above. In some alternative embodiments, the sensor 502 and the valve 504 may be at different locations than shown in FIG. 5 without departing from the scope of this disclosure. In some alternative embodiments, the system 500 may include more or fewer components than shown without departing from the scope of this disclosure. In some alternative embodiments, some of the components of the system 500 may be integrated into a single component without departing from the scope of this disclosure.

Figure 6:
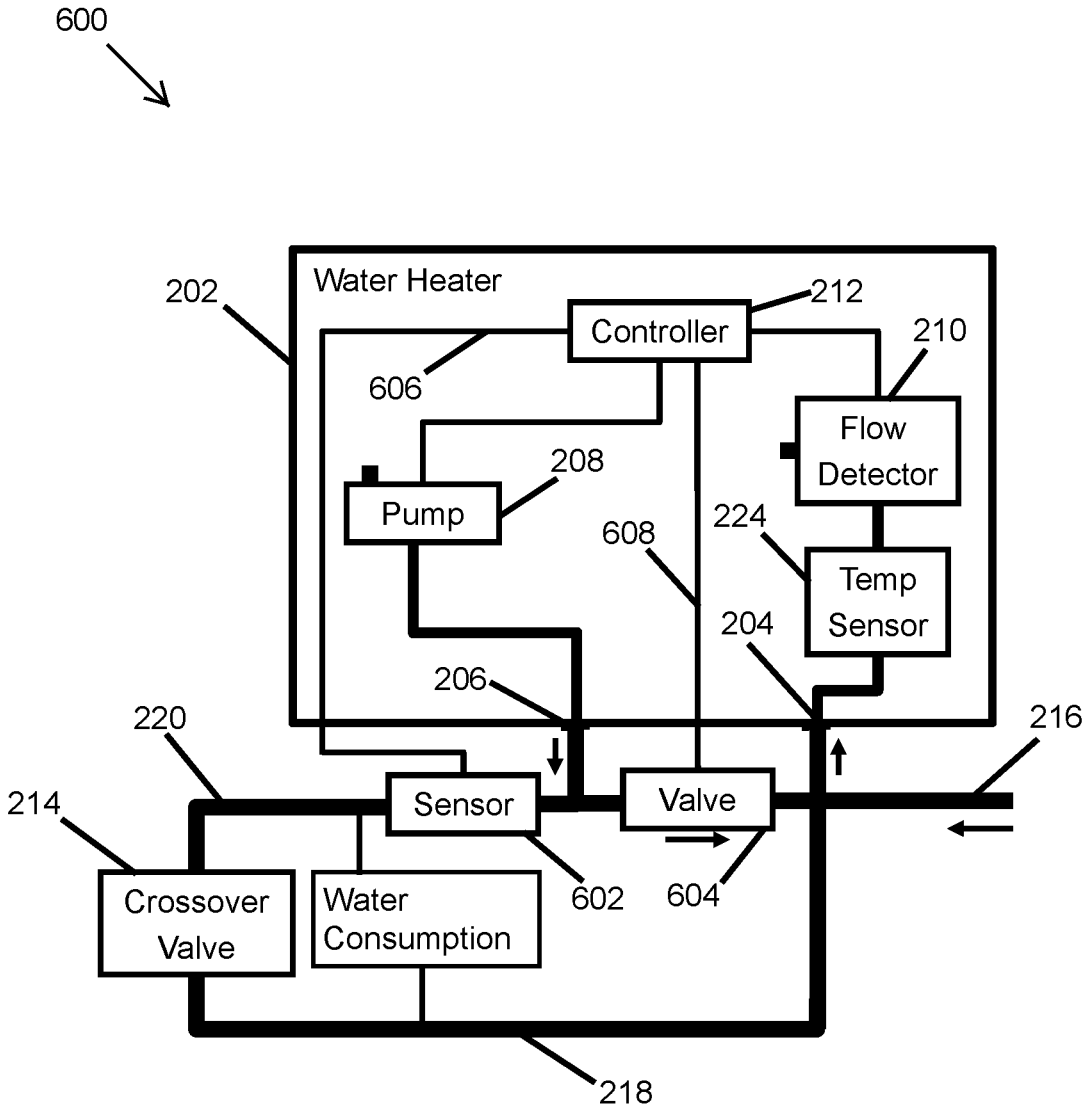
FIG. 6 illustrates a heated water recirculation system that includes a tankless water heater and a crossover valve and that operates based on water pressure detection according to an example embodiment.

FIG. 6 illustrates a heated water recirculation system 600 that includes the tankless water heater 202 and the crossover valve 214 and that operates based on water pressure detection according to an example embodiment. Referring to FIGS. 2, 4, and 6, in some example embodiments, the heated water recirculation system 600 includes the tankless water heater 202, the crossover valve 214, and the water consumption apparatus 222 described above. The water heater 202 may include the recirculation pump 208, the flow detector 210, the controller 212, and the temperature sensor 224 as described above. In general, the system 600 operates in as a similar manner as the systems 200 and 400 to provide heated water and to circulate water through the system 600.

In some example embodiments, in contrast to the system 400 of FIG. 4, the system 600 may include a sensor 602 and a valve 604 instead of the relief valve 402. The sensor 602 may correspond to and operate in the same manner as the sensor 502 of FIG. 5, and the valve 604 may correspond to and operate in the same manner as the valve 504 of FIG. 5. To illustrate, the sensor 602 may be coupled to the piping 220 to sense the water pressure in the system 600, and the valve 604 may be coupled across the water inlet 204 and the water outlet 206 such that the input port/side of the valve 604 is fluidly coupled to the water outlet 206 and the output port/side of the relief valve 604 is fluidly coupled to the water inlet 204. The controller 212 may correspond to and operate in a similar manner as the controller 112 to control the valve 604 based on the pressure sensed by the pressure sensor 602.

To illustrate, the controller 212 may provide a control signal to the valve 604 via an electrical connection 608 to control whether the valve 604 provides a water flow path from the water outlet 206 to the water inlet 204. For example, the pressure sensor 602 may provide to the controller 212, via an electrical connection 606, pressure information indicating the water pressure in the pipe 220. The controller 212 may compare the water pressure against a threshold pressure and determine whether the water pressure exceeds the threshold pressure. The controller 212 may send a command to open the valve 604 in response to determining that the water pressure sensed by the sensor 602 exceeds a threshold pressure. The controller 212 may also send a command to close the valve 604 in response to determining that the water pressure sensed by the sensor 602 is at or below the threshold pressure. As another example, the controller 212 may send a command to adjust the valve 604 based on the water pressure sensed by the sensor 602. For example, the valve 604 may be controlled to adjust the amount of water that flows from the water outlet 206 to the water inlet 204 through the valve 604. In general, the flow path provided by controlling or opening the valve 604 may or may not be through the valve 604 itself.

By allowing water that exits the water heater 202 through the water outlet 206 to circulate back to the water heater 202 through the valve 604 and the water inlet 204, the system 600 may prevent the water pressure in the system 600 from increasing to a threshold level. By preventing excess pressure, the system 600 can prevent damages to the components of the system 600 while allowing the recirculation of water through the system 600 under safe pressure conditions.

In some example embodiments, the controller 212 may control the recirculation pump 208 based on temperature information from the temperature sensor 224 in a similar manner as described above with respect to FIGS. 2 and 4. In some alternative embodiments, the sensor 602 and the valve 604 may be at different locations than shown in FIG. 6 without departing from the scope of this disclosure. For example, the sensor 602 may be at the branch of the piping connected to the valve 604. In some alternative embodiments, the sensor 602 and the valve 604 may be installed in the cabinet of the tankless water heater 202 without departing from the scope of this disclosure. In some alternative embodiments, the system 600 may include more or fewer components than shown without departing from the scope of this disclosure. In some alternative embodiments, some of the components of the system 600 may be integrated into a single component without departing from the scope of this disclosure.

Figure 7:
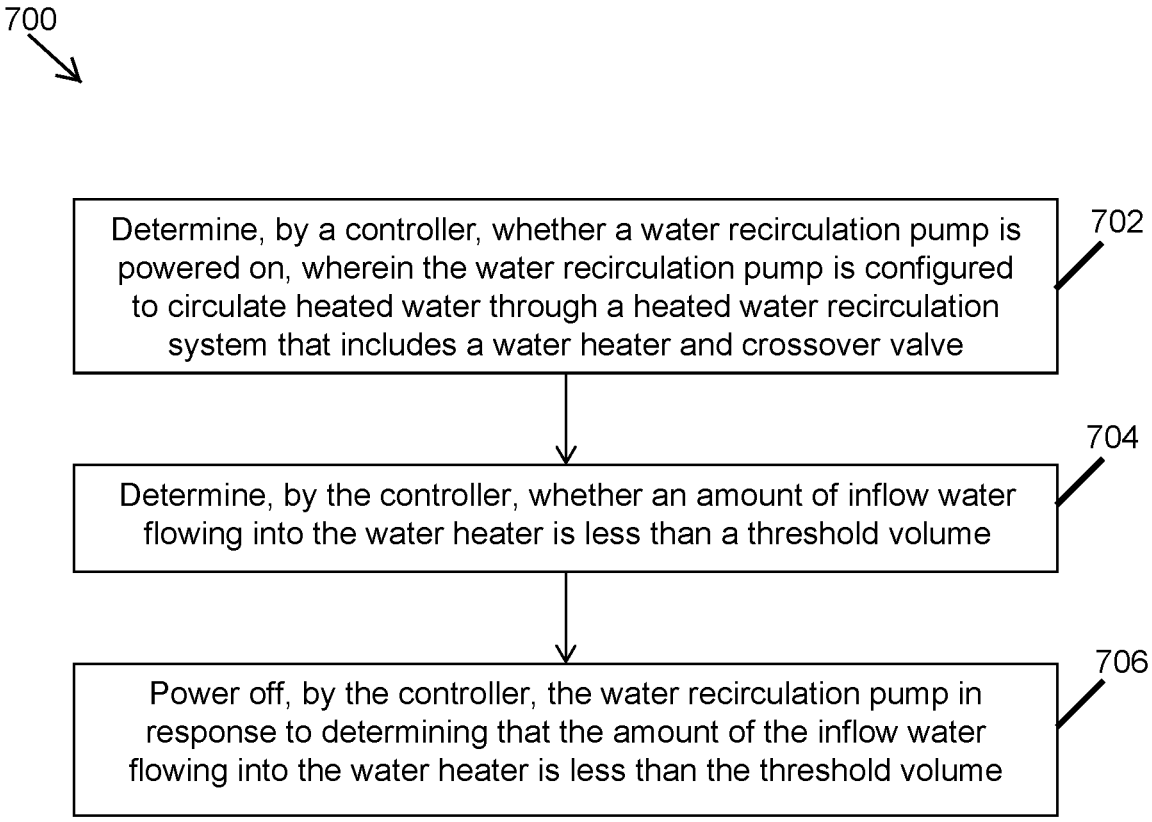
FIG. 7 illustrates a method of operating a heated water recirculation system based on water flow detection according to an example embodiment.

FIG. 7 illustrates a method 700 of operating a heated water recirculation system based on water flow detection according to an example embodiment. Referring to FIGS. 1, 2, and 7, in some example embodiments, at step 702, the method 700 may include determining, by a controller, whether a water recirculation pump is powered on (i.e., pumping water). To illustrate, the water recirculation pump is configured to pump/circulate water through the heated water recirculation system that includes a water heater and a crossover valve. Circulating water through the system may include circulating water heated by the water heater (i.e., heated water) by pumping the heated water or by pumping the inflow water (e.g., circulated water or a combination of circulated water and water from water supply) into the water heater through the water inlet of the water heater.

For example, the controller 112 may determine whether the recirculation pump 108 of the system 100 is powered on. As another example, the controller 212 may determine whether the recirculation pump 208 of the system 200 is powered on. The controller may determine whether the water recirculation pump is powered on, for example, based on a status indicator signal from the recirculation pump that indicates whether power is provided to the recirculation pump and/or based on a control signal provided to the recirculation pump, etc. If the crossover valve is open when the recirculation pump is powered on, water that exits the water heater may circulate back to the water heater through the crossover valve. When the crossover valve is closed, the crossover valve prevents heated water from flowing from the water outlet of the water heater to the water inlet of the water heater through the crossover valve.

At step 704, the method 700 may include determining, by the controller (e.g., the controller 112, 212), whether an amount of the water (i.e., inflow water) flowing into the water heater (e.g., water heater 102, 202) is less than a threshold volume. For example, the controller 112 of FIG. 1 may receive a flow detection signal from the flow detector 110 indicative of the amount of inflow water flowing into the water heater 102 through the water inlet 104 and may determine whether the amount of the water is less or more than a threshold volume. An amount of water that is less than the threshold volume may indicate that the crossover valve 114 is closed or partially closed. As another example, the controller 212 of the system 200 of FIG. 2 may also determine whether the amount of the inflow water flowing into the water heater 202 through the water inlet 204 is less or more than a threshold volume based on a flow detection signal from the flow detector 210.

At step 706, the method 700 may include powering off, by the controller, the water recirculation pump in response to determining that the amount of the inflow water flowing into the water heater equals or is less than the threshold volume. For example, the controller 112 may send a control command to the recirculation pump 108 to stop pumping water in response to the controller 112 determining that the amount of the inflow water flowing into the water heater through the water inlet 104 is less than the threshold volume or equals the threshold volume. To illustrate, the controller 112 may power off the recirculation pump 108 in response to the detection of water by the flow detector 110 (when the flow detector 110 is a flow switch or a flow sensor) or based on the amount of water indicated by the flow detector 110. The controller 212 may similarly control the recirculation pump 208 based on the flow detection signal from the flow detector 210.

In some example embodiments, the method 700 may include detecting, by a flow detector, whether water is flowing into the water heater via the water inlet of the water heater prior to the controller determining whether the amount of water equals or is less than the threshold volume. For example, the flow detector 110 may detect whether water is flowing and/or the amount of inflow water flowing into the water heater 102 via the water inlet 104. The flow detector 210 may detect whether water is flowing and/or the amount of inflow water flowing into the water heater 202 via the water inlet 204.

In some example embodiments, the method 700 may include indicating to the controller, by a flow detector, the amount of the inflow water flowing into the water heater. For example, the flow detector 110 of FIG. 1 may detect the amount of the inflow water flowing into the water heater 102 and the flow detector 210 of FIG. 2 may detect the amount of the inflow water flowing into the water heater 202.

In some example embodiments, one or more steps of the method 700 may be omitted without departing from the scope of this disclosure. In some example embodiments, the method 700 may include additional steps without departing from the scope of this disclosure. In some example embodiments, some of the steps of the method 700 may be performed in a different order than described above without departing from the scope of this disclosure.

Figure 8:
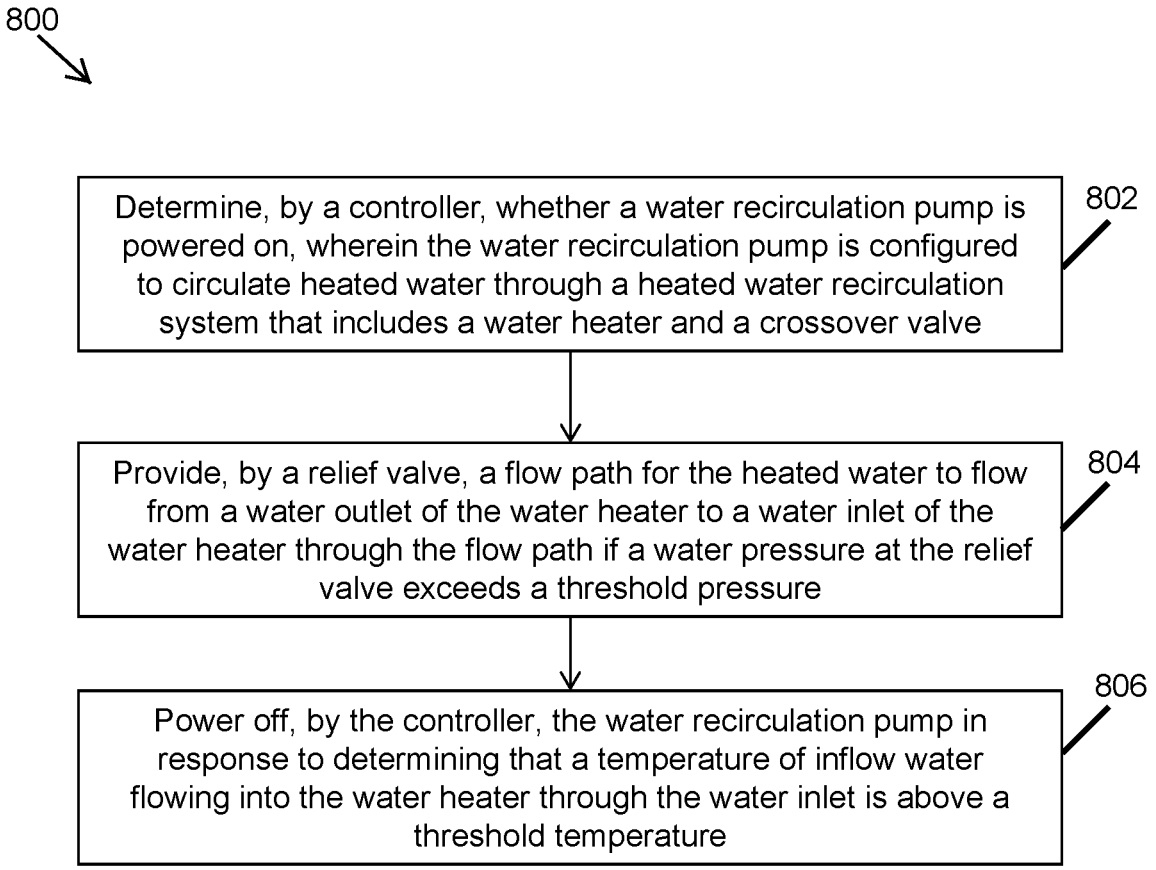
FIG. 8 illustrates a method of operating a heated water recirculation system based on a water pressure of the heated water recirculation system according to an example embodiment.

FIG. 8 illustrates a method 800 of operating a heated water recirculation system based on a water pressure of the heated water recirculation system according to an example embodiment. Referring to FIGS. 3, 4, and 8, in some example embodiments, at step 802, the method 800 may include determining, by a controller (e.g., the controller 112, 212), whether a water recirculation pump (e.g., the recirculation pump 110, 210) is powered on. The water recirculation pump is configured to pump/circulate heated water through the heated water recirculation system (e.g., the system 300, 400) that includes a water heater (e.g., the water heater 102, 212) and a crossover valve (e.g., the crossover valve 114, 214). When the crossover valve is open, the crossover valve provides a flow path from the water outlet of the water heater to the water inlet of the water heater through the crossover valve. When the crossover valve is closed, the crossover valve prevents heated water from flowing from the water outlet of the water heater to the water inlet of the water heater through the crossover valve.

At step 804, the method 800 may include providing, by a relief valve (e.g., the relief valve 302, 402), a flow path for the heated water to flow from a water outlet of the water heater to a water inlet of the water heater through the flow path if a water pressure at the relief valve exceeds a threshold pressure. For example, the water pressure at the input of the relief valve may exceed the threshold pressure if the recirculation pump continues to pump water while the crossover valve is closed.

At step 806, the method 800 may include powering off, by the controller, the water recirculation pump in response to determining that a temperature of inflow water flowing into the water heater through the water inlet is above a threshold temperature. For example, the inflow water may include the heated water flowing through the flow path provided by the relief valve.

In some example embodiments, the method 800 may include powering on the recirculation pump in response to a user input or based on a timer. For example, the user input may be provided to the controller, and the controller may power on the recirculation pump. If the recirculation pump is powered back on, the controller may power the recirculation pump back off if the temperature of the inflow water is above the threshold temperature a time period (e.g., 5 seconds, 10 seconds, or 15 seconds) after the recirculation pump was powered back on.

In some example embodiments, the method 800 may include closing, by the relief valve, the flow path in response to the pressure at the relief valve being below the (first) threshold pressure or another threshold pressure that is less than the first threshold pressure. For example, the relief valve may be closed when the pressure at the input of the relief valve decreases, for example, when the crossover valve opens.

In some example embodiments, one or more steps of the method 800 may be omitted without departing from the scope of this disclosure. In some example embodiments, the method 800 may include additional steps without departing from the scope of this disclosure. In some example embodiments, some of the steps of the method 800 may be performed in a different order than described above without departing from the scope of this disclosure.

Figure 9:
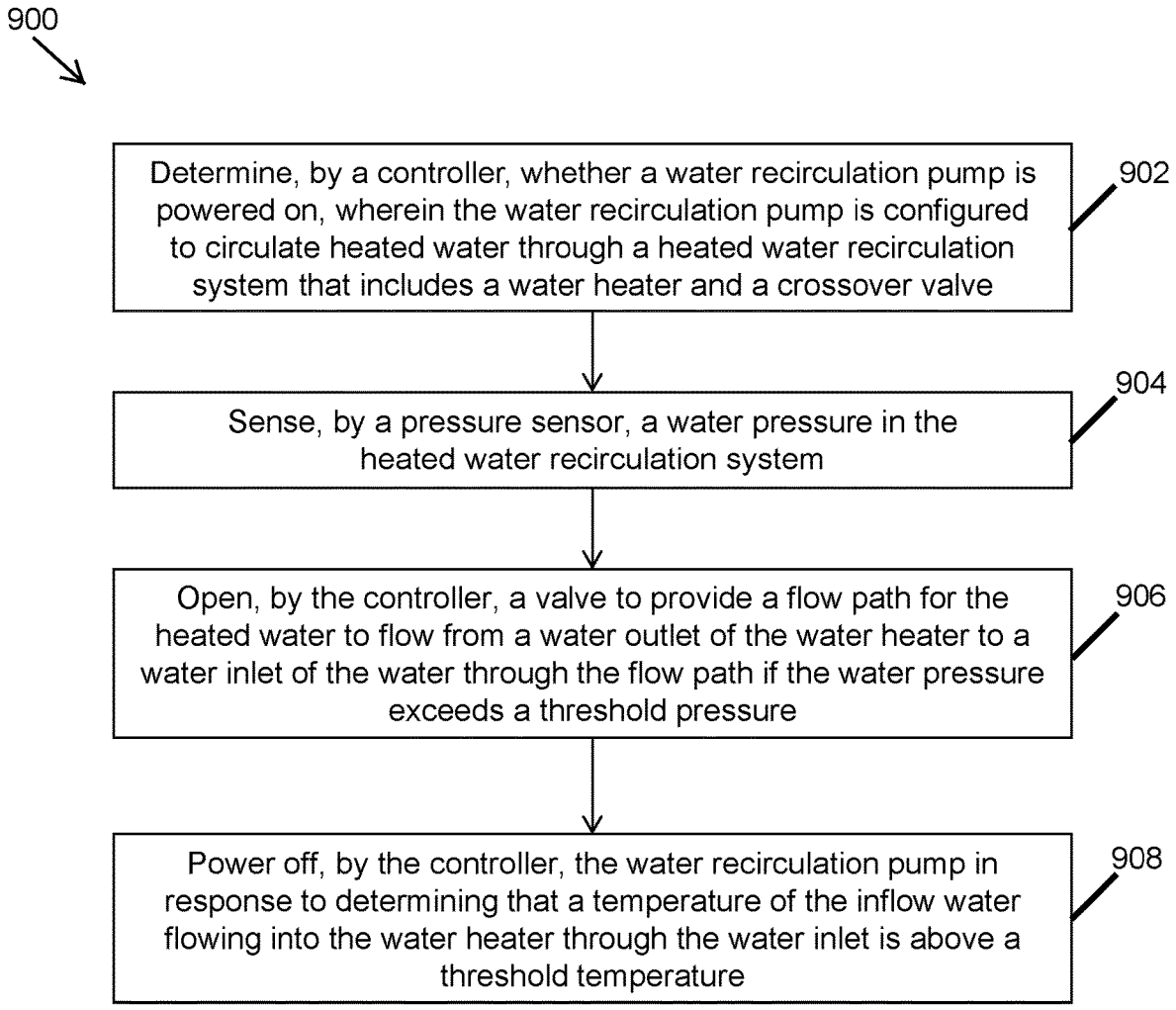
FIG. 9 illustrates a method of operating a heated water recirculation system based on the water pressure of the heated water recirculation system according to another example embodiment.

FIG. 9 illustrates a method 900 of operating a heated water recirculation system based on the water pressure of the heated water recirculation system according to another example embodiment. Referring to FIGS. 5, 6, and 9, in some example embodiments, at step 902, the method 900 may include determining, by a controller (e.g., the controller 112, 212), whether a water recirculation pump (e.g., the recirculation pump 110, 210) is powered on. The water recirculation pump is configured to pump/circulate heated water through the heated water recirculation system (e.g., the system 500, 600) that includes a water heater (e.g., the water heater 102, 212) and a crossover valve (e.g., the crossover valve 114, 214). When the crossover valve is open, the crossover valve provides a flow path from the water outlet of the water heater to the water inlet of the water heater through the crossover valve, thus allowing the heated water to circulate back to the water heater. When the crossover valve is closed, the crossover valve prevents heated water from flowing from the water outlet of the water heater to the water inlet of the water heater through the crossover valve.

At step 904, the method 900 may include sensing, by a pressure sensor (e.g., the pressure sensor 502, 602), a water pressure in the heated water recirculation system. To illustrate, the pressure sensor may be located to sense the water pressure in the piping of the heated water recirculation system that is fluidly coupled to the water outlet of the water heater regardless of whether the crossover valve is closed. For example, the piping may fluidly couple the water outlet of the water heater to the crossover valve. When the crossover valve is closed, the water pressure may increase if the recirculation pump continues to pump water from or through the water heater toward the crossover valve. The method 900 may include providing to the controller, by the pressure sensor, pressure information indicative of the water pressure sensed by the pressure sensor, and the controller may determine whether the water pressure exceeds the threshold pressure.

At step 906, the method 900 may include opening, by the controller, a valve (e.g., the valve 504, 604 that are electronic valves) to provide a flow path for the heated water to flow from the water outlet of the water heater to the water inlet of the water through the flow path if the water pressure exceeds a threshold pressure. Water pressure that exceeds the threshold pressure may indicate that the crossover valve is closed. The controller may provide a control signal to the valve, for example, to open the valve or otherwise provide the flow path in response to determining that the water pressure exceeds a threshold pressure. If the water pressure does not exceed the threshold pressure, the controller may send or maintain a control command to keep the valve closed. The method 900 may include closing, by the controller, the valve to prevent the heated water from flowing from the water outlet of the water heater to the water inlet of the water through the flow path if the water pressure is below the threshold pressure.

At step 908, the method 900 may include powering off, by the controller, the water recirculation pump in response to determining that a temperature of the inflow water flowing into the water heater through the water inlet is above a threshold temperature. For example, the inflow water may include the heated water flowing through the flow path provided by the valve.

In some example embodiments, the method 900 may include powering on the recirculation pump in response to a user input or based on a timer. For example, the user input may be provided to the controller, and the controller may power on the recirculation pump. If the recirculation pump is powered back on, the controller may power the recirculation pump back off if the temperature of the inflow water flowing into the water inlet is above the threshold temperature a time period (e.g., 5 seconds, 10 seconds, or 15 seconds) after the recirculation pump was powered back on.

In some example embodiments, one or more steps of the method 900 may be omitted without departing from the scope of this disclosure. In some example embodiments, the method 900 may include additional steps without departing from the scope of this disclosure. In some example embodiments, some of the steps of the method 900 may be performed in a different order than described above without departing from the scope of this disclosure.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive.

From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A heated water recirculation system, comprising:

a water heater having a water inlet configured to receive inflow water and a water outlet configured to output heated water;

a flow detector;

a recirculation pump; and a controller configured to:

receive, from the flow detector, data indicative of the amount of inflow water flowing toward the water inlet;

determine whether the amount of inflow water is less than or equal to a threshold amount of inflow water, the threshold amount of inflow water being 10% or less of a maximum amount of inflow water, wherein the amount of inflow water being less than 10% of the maximum amount of inflow water is indicative of a crossover valve at least partially restricting a flow path extending between the water outlet and the water inlet, the crossover valve at least partially preventing recirculation of the heated water from the water outlet to the water inlet; and in response to determining the amount of inflow water is less than or equal to the threshold amount of inflow water, output a signal to the recirculation pump to reduce pumping to prevent excessive water pressure from building up in the heated water recirculation system;

wherein the flow detector is positioned to detect the inflow water flowing into the water heater through the water inlet of the water heater and the recirculation pump.

2. The heated water recirculation system of claim 1, wherein the recirculation pump is located at the water outlet to pump the heated water from the water heater.

3. The heated water recirculation system of claim 1, wherein the recirculation pump is located at the water inlet to pump the inflow water into the water heater.

4. The heated water recirculation system of claim 1, wherein the controller is configured to output a signal to the recirculation pump to power off the recirculation pump in response to the amount of inflow water being 10% or less of the maximum amount of inflow water.

5. The heated water recirculation system of claim 4, wherein the controller is configured to determine whether the recirculation pump is powered on before powering off the recirculation pump.

6. A heated water recirculation system, comprising:

a water heater having a water inlet configured to receive inflow water and a water outlet configured to output heated water;

a flow detector;

a recirculation pump configured to pump water through the heated water recirculation system when the recirculation pump is powered on;

a crossover valve configured to provide a flow path extending from the water outlet to the water inlet outside of the water heater when the crossover valve is open; and a controller configured to:

receive, from the flow detector, data indicative of the amount of inflow water flowing toward the water inlet;

compare the amount of inflow water to a threshold amount of inflow water, the threshold amount of inflow water being 10% or less of a maximum amount of inflow water;

based on the comparison of the amount of inflow water to the threshold amount of inflow water, determine if the crossover valve is at least partially restricting the inflow water from circulating; and in response to determining the amount of inflow water is less than or equal to the threshold amount of inflow water, output a signal to the recirculation pump to reduce pumping to prevent excessive water pressure from building up in the heated water recirculation system;

wherein the flow detector is positioned to detect the inflow water flowing into the water heater through the water inlet of the water heater and the recirculation pump.

7. The heated water recirculation system of claim 6, wherein the recirculation pump is located at the water outlet to pump the heated water from the water heater.

8. The heated water recirculation system of claim 6, wherein the recirculation pump is located at the water inlet to pump the inflow water into the water heater.

9. The heated water recirculation system of claim 6, wherein the controller is configured to output a signal to the recirculation pump to power off the recirculation pump in response to the amount of inflow water being less than or equal to the threshold amount of inflow water.

10. The heated water recirculation system of claim 9, wherein the controller is configured to determine whether the recirculation pump is powered on before powering off the recirculation pump.

11. The heated water recirculation system of claim 6, wherein the flow detector includes a flow sensor or a flow switch.

12. The heated water recirculation system of claim 6, wherein the water heater is a tankless water heater.

13. A method of controlling a recirculation of heated water, the method comprising:

determining, by a controller, whether a water recirculation pump is powered on, wherein, when powered on, the water recirculation pump is configured to circulate the heated water through a water recirculation system that includes a water heater and a crossover valve, wherein the crossover valve provides a flow path for the heated water to flow between a water outlet of the water heater and a water inlet of the water heater when the crossover valve is open;

indicating to the controller, by a flow detector, the amount of inflow water flowing into the water heater, wherein the flow detector is located to detect the inflow water flowing into the water heater through the water inlet of the water heater and the recirculation pump;

determining, by the controller, whether an amount of inflow water flowing into the water heater is less than a threshold volume, the threshold volume being 10% or less of a maximum amount of inflow water that flows toward the water inlet, wherein the amount of inflow water flowing into the water heater being less than the threshold volume is indicative of the crossover valve at least partially restricting the heated water disposed within the flow path between the water outlet and the crossover valve from circulating to the water inlet via the flow path; and powering off, by the controller, the water recirculation pump to prevent excessive water pressure from building up in the water recirculation system, in response to determining that the amount of inflow water flowing into the water heater is less than or equal to the threshold volume.

14. The method of claim 13, wherein the water heater is a tankless water heater.

* * * * *